US008690311B2

(12) United States Patent
Caruthers et al.

(10) Patent No.: US 8,690,311 B2
(45) Date of Patent: Apr. 8, 2014

(54) METHODS OF TREATING INK ON POROUS SUBSTRATES USING PARTIAL CURING AND APPARATUSES USEFUL IN TREATING INK ON POROUS SUBSTRATES

(75) Inventors: Edward B. Caruthers, Rochester, NY (US); Michael D. Thompson, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 139 days.

(21) Appl. No.: 12/881,837

(22) Filed: Sep. 14, 2010

(65) Prior Publication Data

US 2012/0062668 A1 Mar. 15, 2012

(51) Int. Cl.
*B41J 2/01* (2006.01)
*B41J 2/015* (2006.01)

(52) U.S. Cl.
USPC ..... 347/102; 347/21

(58) Field of Classification Search
None
See application file for complete search history.

(56) References Cited

U.S. PATENT DOCUMENTS 6,444,294 B1 * 9/2002 Malhotra et al. ..... 428/32.24
7,531,582 B2 5/2009 Toma et al.
7,559,639 B2 7/2009 Belelie et al.
7,665,835 B2 2/2010 Goredema et al.
7,714,040 B2 5/2010 Toma et al.
7,789,503 B2 * 9/2010 Kusunoki ..... 347/102
2007/0120930 A1 5/2007 Domoto et al.
2007/0123606 A1 5/2007 Toma et al.
2008/0250973 A1 * 10/2008 Leenders et al. ..... 106/31.92
2009/0086000 A1 * 4/2009 Yokota ..... 347/102
2010/0053289 A1 * 3/2010 Thompson ..... 347/102
2010/0101716 A1 4/2010 Roof et al.
2010/0101717 A1 4/2010 Roof
2010/0103235 A1 4/2010 Roof et al.
2010/0177151 A1 * 7/2010 Thompson et al. ..... 347/102

* cited by examiner

*Primary Examiner* — Stephen Meier
*Assistant Examiner* — Alexander C Witkowski
(74) *Attorney, Agent, or Firm* — Ronald E. Prass, Jr.; Prass LLP

(57) ABSTRACT

Methods of treating ink on a porous substrate and methods of printing onto porous substrates are provided. An exemplary embodiment of the methods of treating ink on a porous substrate includes applying a layer of ink onto a first surface of a porous substrate; irradiating the layer of ink with first radiation having a first spectrum effective to partially cure the ink layer and reduce penetration of the ink into pores of the substrate; leveling the partially-cured ink layer; and irradiating the as-leveled ink layer with second radiation to further cure the ink layer, the second radiation having a second spectrum different from the first spectrum of the first radiation.

28 Claims, 5 Drawing Sheets

METHODS OF TREATING INK ON POROUS SUBSTRATES USING PARTIAL CURING AND APPARATUSES USEFUL IN TREATING INK ON POROUS SUBSTRATES

RELATED APPLICATIONS

This application is related to the applications entitled "METHODS OF FORMING IMAGES ON SUBSTRATES WITH INK PARTIAL-CURING AND CONTACT LEVELING AND APPARATUSES USEFUL IN FORMING IMAGES ON SUBSTRATES" Ser. No. 12/881,715; "METHODS OF ADJUSTING GLOSS OF IMAGES LOCALLY ON SUBSTRATES USING INK PARTIAL-CURING AND CONTACT LEVELING AND APPARATUSES USEFUL IN FORMING IMAGES ON SUBSTRATES" Ser. No. 12/881,753 and "METHODS OF ADJUSTING GLOSS OF IMAGES ON SUBSTRATES USING INK PARTIAL-CURING AND CONTACT LEVELING AND APPARATUSES USEFUL IN FORMING IMAGES ON SUBSTRATES" Ser. No. 12/881,802, which are each filed on the same date as the present application, commonly assigned to the assignee of the present application, and incorporated herein by reference in its entirety.

BACKGROUND

In printing processes, marking material is applied onto substrates to form images. In some processes, the printed images can show through porous substrates due to ink penetration in the substrates. Ink show-through can make the substrates unsuitable for duplex printing.

It would be desirable to provide methods of treating ink on porous substrates and apparatuses useful in printing that can reduce ink penetration in porous substrates and provide desirable images.

SUMMARY

Methods of treating ink on substrates and apparatuses useful in treating ink on porous substrates are provided. An exemplary embodiment of the methods of treating ink on a substrate comprises applying a layer of ink onto a first surface of a porous substrate; irradiating the layer of ink with first radiation having a first spectrum effective to partially cure the ink layer and reduce penetration of the ink into pores of the substrate; leveling the partially-cured ink layer; and irradiating the as-leveled ink layer with second radiation to further cure the ink layer, the second radiation having a second spectrum different from the first spectrum of the first radiation.

DRAWINGS

DETAILED DESCRIPTION

Figure 1:
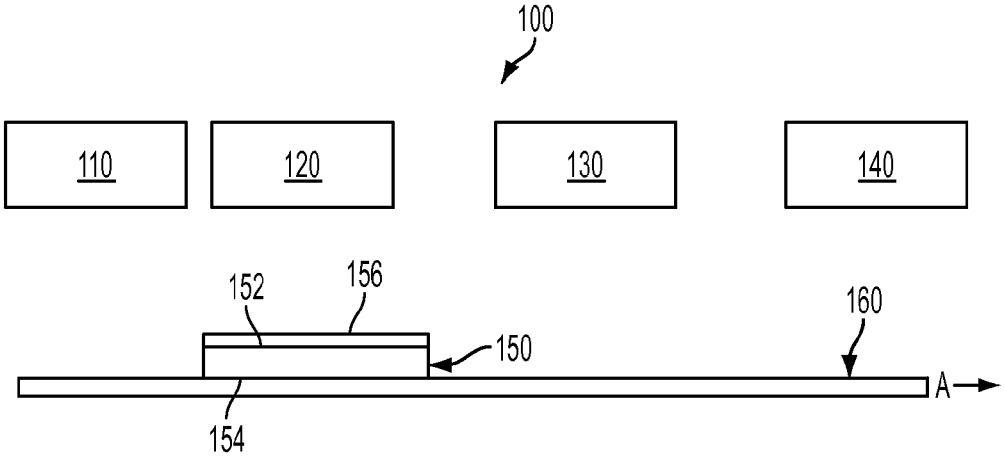
FIG. 1 depicts an exemplary embodiment of a printing apparatus including a partial curing device that irradiates an ink layer on a surface of a substrate from above the surface.

The disclosed embodiments include methods of treating ink on substrates. An exemplary embodiment of the methods comprises applying a layer of ink onto a first surface of a porous substrate; irradiating the layer of ink with first radiation having a first spectrum effective to partially cure the ink layer and reduce penetration of the ink into pores of the substrate; leveling the partially-cured ink layer; and irradiating the as-leveled ink layer with second radiation to further cure the ink layer, the second radiation having a second spectrum different from the first spectrum of the first radiation.

The disclosed embodiments further include methods of printing onto porous substrates. An exemplary embodiment of the methods comprises applying at least one photoinitiator compound over a first surface of a porous substrate; applying a layer of ink over the first surface; irradiating the layer of ink with first radiation having a first spectrum effective to partially cure the ink layer and reduce penetration of the ink into pores of the substrate, wherein the at least one photoinitiator compound is tuned to the first spectrum; leveling the partially-cured ink layer; and irradiating the as-leveled ink layer with second radiation to further cure the ink layer, the second radiation having a second spectrum different from the first spectrum of the first radiation.

The disclosed embodiments further include apparatuses useful in treating ink on a porous substrate. An exemplary embodiment of the apparatuses comprises a marking device for applying a layer of ink onto a first surface of a porous substrate; a first curing device for irradiating the layer of ink with first radiation having a first spectrum effective to partially cure the ink layer and reduce penetration of the ink into pores of the substrate; a leveling device for leveling the partially-cured ink layer; and a second curing device for irradiating the as-leveled ink layer with second radiation to further cure the ink layer, the second radiation having a second spectrum different from the first spectrum of the first radiation.

In some printing processes, hot ink, such as UV-curable ink, is deposited on a porous substrate, such as plain paper. The as-deposited ink can penetrate into the printed surface of the substrate during cooling of the ink while it is still sufficiently hot and has a low viscosity. Consequently, the prints can display excessive "print-through," which is a measure of ink permeation in the thickness direction of the substrates, when applied on porous substrates. "Show-through" (ST) is defined as the back surface optical density of a printed porous substrate, such as plain paper. If OD(CP) is defined as the optical density (OD) of the front surface of the substrate covered by a blank sheet of the same substrate, then print-through (PT) is defined as: PT=ST−OD(CP). As the degree of print-through in a porous substrate increases, the printed image on the front surface can become increasingly visible from the back surface. This ink visibility can interfere with satisfactory duplex printing on porous substrates.

For a porous substrate, such as plain paper, when ink is applied to a surface of the substrate lateral ink spreading and ink penetration of the substrate occur together. To reduce the rate of penetration of a hot ink into a porous substrate, such as plain paper, the substrate can be cooled to quickly increase the ink viscosity on the printed surface. The substrate can be cooled by contacting it with a cooled surface. It has been noted, however, that when the amount of time between printing onto the substrate and curing of the applied ink is too long, additional ink penetration into the substrate can occur even after the ink viscosity has been lowered by cooling. It has further been noted that even when ink penetration into a substrate is more effectively controlled by cooling, and is only slight, the ink line width on the printed surface may not be increased sufficiently by lateral ink spreading, and nominally-solid image areas can appear streaky on the surface. Such prints are also unsatisfactory.

In light of these observations, as well as other considerations, methods of treating ink on porous substrates and corresponding apparatuses that can provide reduced ink penetration of the substrates are provided. The methods and apparatuses also can produce imaged areas with suitable line widths. Embodiments of the methods comprise exposing a layer of ink applied to a surface of a substrate with radiant energy to only partially cure the ink. The partial curing reduces penetration of the ink into pores of the substrate, i.e., print-through, but also allows the partially-cured ink layer to be leveled sufficiently on the substrate. The as-leveled ink layer can be subjected to further curing using radiant energy to increase the ink viscosity and surface hardness and adhesion of the ink layer onto the substrate, to provide a robust image.

FIG. 1 depicts an exemplary embodiment of an apparatus 100 useful in treating ink on porous substrates. The apparatus 100 includes a marking device 110, a first curing device 120, a leveling device 130 and a second curing device 140, arranged in this order along process direction, A. A substrate 150 having a front surface 152 and an opposite back surface 154 is shown supported on a movable transport device 160. The marking device 110 deposits ink onto a front surface 152 of the substrate 150 to form an ink layer 156; the first curing device 120 irradiates the ink layer 156 with radiant energy to partially cure the ink layer 156; the leveling device 130 levels (i.e., laterally spreads) the partially-cured ink layer 156 on the front surface 152; and the second curing device 140 irradiates the as-leveled ink layer 156 with radiant energy to further cure the ink layer 156.

In embodiments, the first curing device 120, leveling device 130 and second curing device 140 are stationary and the substrate 150 is moved past these devices by the transport device 160 while being irradiated. The transport speed of the substrate 150 past these devices can be varied to control the exposure time of the ink layer 156. Increasing the print speed decreases the amount of time between printing and partial curing and decreases the amount of ink penetration into a porous substrate that occurs before the partial curing. In embodiments, the radiant energy sources of the first curing device 120, second curing device 140 and an optional radiant energy source of the leveling device 130 can be turned ON throughout the partial curing, leveling and further curing, respectively, to allow up to the entire front surface 152 to be irradiated as the substrate 150 is moved continuously past these devices.

The illustrated substrate 150 is a sheet of a porous material. For example, the substrate 150 can be a sheet of plain paper. The paper can be coated or uncoated. The paper can have smooth front and back surfaces, and can be glossy. In general, coated papers with glossy surfaces are less porous than uncoated or "plain" paper. Embodiments of the apparatus 100 are most useful for printing on more porous, uncoated, plain papers. The In other embodiments, the substrate can comprise a continuous web of porous material, such as plain paper, or the like, and the transport device 160 can be replaced by fixed plates that can be heated or cooled to control the web temperature at various positions. The substrate 150 includes open pores extending partially or completely through the thickness dimension of the substrate 150 between the front surface 152 and the opposite back surface 154. Ink may also be deposited on the back surface 154 to produce duplex prints.

The transport device 160 transports the substrate 150 in the process direction A past the marking device 110, first curing device 120, leveling device 130 and the second curing device 140 to produce images on the substrate 150. The substrate 150 is typically oriented relative to the leveling device with the length dimension of the substrate extending along the process direction A. The transport device 160 can comprise a belt, rollers, or other suitable components, to transport the substrate 150 in the apparatus 100. When the substrate 150 is a continuous web, the transport device 160 may be a stationary support device (not shown) and the web may be pulled over the support device configured to support the web at a fixed distance from the marking device 110, first curing device 120, leveling device 130 and the second curing device 140.

In embodiments, the marking device 110 can include multiple print heads (not shown) arranged to deposit ink in the form of droplets on the front surface 152 of the substrate 150. For example, the print heads can be heated piezo print heads. The print heads can typically be arranged in multiple, staggered rows in the marking device 110. The print heads can be used with cyan, magenta, yellow and black inks, to allow inks of different colors to be printed atop each other on the substrate 150. The print heads may also contain clear inks, metallic inks, fluorescent inks, or inks with customer-selected colors, such as those exemplified by the Pantone® Color Matching System from Pantone® Inc. of Carlstadt, New Jersey.

The ink has a composition that can be cured using radiant energy. For example, the ink can comprise ultraviolet light (UV)-curable ink. UV-curable inks are applied to a surface of a substrate and then exposed to UV radiation to cure the ink and fix images onto the surface. Curing produces polymerization and cross-linking in the inks, which increases ink viscosity, ink surface hardness and ink adhesion. UV-curable inks can be applied to substrates using print heads. These inks can typically be heated to a temperature of about 80° C. to about 100° C. and jetted while at a low viscosity of about 10 cP. When these inks impinge on a cooler substrate, such as plain paper at ambient temperature, they cool to the substrate temperature. During cooling, the inks become increasingly viscous. The viscosity of UV-curable inks can typically increase to about 1000 CP to about 10,000 cP during this cooling period.

Figure 2:
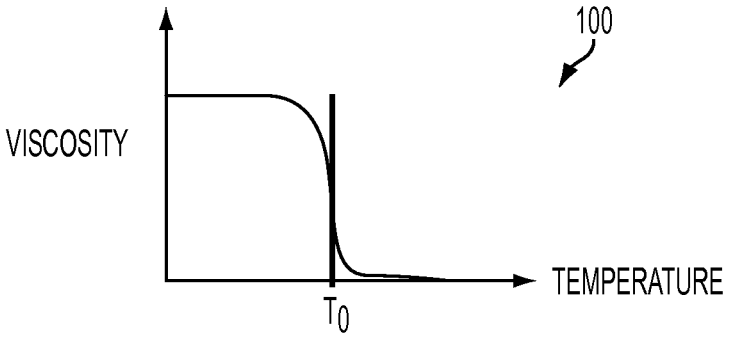
FIG. 2 shows a curve illustrating the viscosity as a function of temperature for a gel ink.

The UV-curable inks can include wax and/or gel components. UV-curable gel inks ("UV gel inks"), which contain gel components, are heated to abruptly reduce their viscosity and then applied to substrates. These inks freeze upon contact with the cooler substrates. FIG. 2 depicts a curve illustrating the viscosity as a function of temperature for a typical gel ink that can be used embodiments of the disclosed methods. As shown, the viscosity profile for the gel ink has a sharp threshold and the ink transitions from being relatively viscous (having a viscosity of, e.g., on the order or greater than about $10^6$ cP) and unable to flow easily, to being relatively non-viscous (having a viscosity of, e.g., on the order of less than about $10^1$ cP) and able to flow easily over a relatively narrow temperature range. Such gel inks can exhibit a large change in viscosity over a small temperature range of less than about 40 Celsius degrees, such as less than about 30 Celsius degrees ° C., or less than about 20 Celsius degrees.

Exemplary inks having viscosity versus temperature characteristics as depicted in FIG. 2 and which can be used to form images on substrates in embodiments of the disclosed methods and apparatuses are described in U.S. Pat. No. 7,665,835, which discloses a phase change ink comprising a colorant, an initiator, and an ink vehicle; in U.S. Patent Application Publication No. 2007/0123606, which discloses a phase change ink comprising a colorant, an initiator, and a phase change ink carrier; and in U.S. Pat. No. 7,559,639, which discloses a radiation curable ink comprising a curable monomer that is liquid at 25° C., curable wax and colorant that together form a radiation curable ink, each of which is incorporated herein by reference in its entirety.

In the curve shown in FIG. 2, there is a viscosity threshold temperature $T_0$, which is defined as the temperature at which the viscosity of the ink is midway between its minimum and maximum values. The print heads of the marking device 110 can heat the ink to a sufficiently-high temperature to reduce the ink viscosity to a suitable viscosity for jetting from the nozzles. For example, gel inks can be heated to a temperature above the viscosity threshold temperature, e.g., at least about 80° C., to develop the desired viscosity for jetting. The hot ink is jetted as droplets from the nozzles of the print heads onto a substrate being transported past the marking device 110. UV gel inks can typically exhibit a large increase in viscosity when cooled from the jetting temperature by about 10 Celsius degrees, e.g., from about 80° C. to about 70° C. When the gel ink impinges on a substrate, such as plain paper, heat is transferred from the ink to the cooler substrate. The as-deposited gel ink rapidly cools and develops a gel consistency on the substrate. Due to the rapid cooling, the gel ink does not have sufficient time to reflow laterally, or level, on the substrate.

Positive pressure pumps with controlled needle valves, such as a Smart Pump™ 20, available from nScrypt, Inc. of Orlando, Fla., can eject very small volumes down to picoliters, at very high viscosities, such as viscosities above $10^6$ cP. Such pumps can be used in the marking device 110 to deposit gel inks at ambient temperature onto a substrate.

In the apparatus 100, the ink layer 156 applied to the front surface 152 of the substrate 150 by the marking device 110 is irradiated with radiant energy emitted by the first curing device 120 from above the front surface 152 to partially cure the ink. As used herein, the term "partial cure" means that some parts of the ink layer are cured sufficiently to reduce ink penetration into the substrate, but that the ink layer remains able to flow or spread without elastically recovering its original dimensions after the spreading force has been removed. In some embodiments, the part of the ink layer nearest to the substrate is more cured than the part of the ink layer farthest from the substrate. In other embodiments, the entire ink layer is cured to an intermediate level of viscosity. The spectrum of the radiant energy emitted by the first curing device 120 is effective to partially cure the ink layer 156 and reduce penetration of the ink into pores of the substrate 150. The "spectrum" of the radiant energy is generally provided by a graph giving the intensity of the radiant energy at a range of wavelengths extending from the far UV (about 100 nm wavelength) to the near UV (about 400 nm wavelength).

The partially-cured ink layer 156 has viscosity and hardness characteristics that allow the ink layer 156 to be leveled using the leveling device 130 to spread the ink laterally on the front surface 152 to increase the line width of the ink layer 156. The width of the line written by a single jet will depend on drop mass, jetting frequency, substrate speed, and ink spreading on the substrate. Similarly, the desired spreading of a line will depend on the as-jetted line width and the distance between lines written by the nozzles in a particular print head. In some embodiments, the as-jetted line width is about 50 μm to about 60 μm and it is desirable to produce a line width of at least about 75 μm on the front surface 152.

Figure 3:
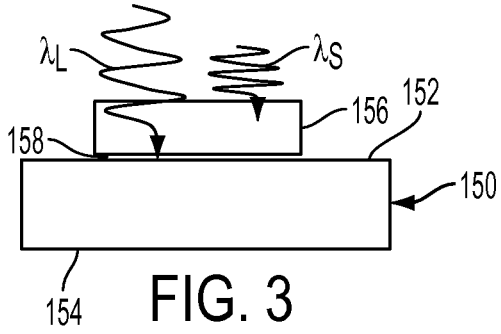
FIG. 3 depicts the penetration of radiant energy having a long wavelength ($\lambda_L$) and having a short wavelength ($\lambda_S$) in an ink layer disposed on a porous substrate.
Figure 4:
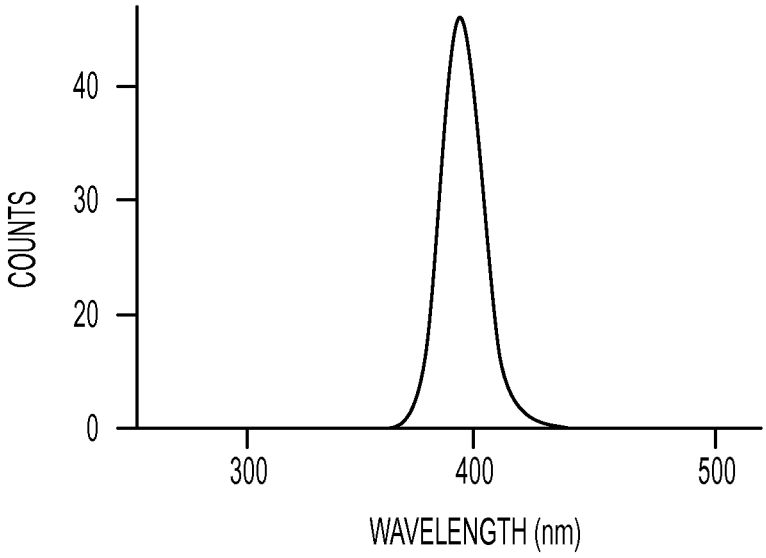
FIG. 4 shows an exemplary emission spectrum of a radiant energy source of a partial curing device.

As shown in FIG. 3, in embodiments of the methods, the radiant energy emitted by the first curing device 120 has a relatively long wavelength, $\lambda_L$, that is effective to penetrate deeply into the ink layer 156 to the interface 158 defined between the ink layer 156 and the front surface 152 of the substrate 150. A short wavelength, $\lambda_S$, which does not penetrate deeply into the ink layer 156, is shown for comparison. For example, for UV-curable ink, the radiant energy can comprise UV radiation. FIG. 4 shows a spectrum of UV radiation centered at a wavelength of about 395 nm that is suitable for partially curing UV-curable inks in embodiments of the methods.

In embodiments, the first curing device 120 includes at least one radiant energy source. For example, the radiant energy source can be a light-emitting diode (LED) array, or the like. The radiant energy source can be selected to emit radiant energy having a spectrum that is optimized for the ink composition used in printing in order to produce optimized partial curing of the ink layer 156.

In embodiments, the ink layer 156 is irradiated with radiant energy by the first curing device 120 within a sufficiently-short amount of time after the ink has been applied to the front surface 152 of the substrate 150 by the marking device 110, to preferentially cure the ink adjacent to the front surface 152 before any significant ink permeation into the substrate 150 can occur. In embodiments, it is desirable for the print-through, PT, of the ink into the substrate to have a value of less than about 0.04, such as less than about 0.03, or less than about 0.02 when determined as described using the equation: PT=ST−OD(CP). The ink at the interface 158 between the ink layer and the front surface 152 of the substrate 150 is substantially cured and unable to penetrate into pores of the substrate. The cured ink at the interface 158 provides a barrier against additional ink penetration into the substrate 150.

To achieve partial curing of the ink layer 156 with minimal ink penetration into the substrate 150, it is desirable to position the first curing device 120 close to the marking device 110 to allow the ink layer 156 to be irradiated shortly after being applied to the substrate 150. For example, the first curing device 120 can be spaced from the marking device 110 by a distance of about 1 cm to about 5 cm along the process direction A. As ink penetration is a function of both contact time and ink viscosity, it may be desirable to increase the distance between jetting and partial curing as substrate speed increases and/or reduce the distance between jetting and partial cure as the viscosity of the jetted ink decreases.

During printing, the substrate 150 can be cooled, such as using a temperature-controlled platen disposed under the substrate 150, to increase the cooling rate of the ink as the ink strikes the front surface 152 of the substrate 150. By cooling the ink, the ink layer 156 can be irradiated by the first curing device 120 for less time to achieve the desired partial cooling and minimum penetration of the ink into the substrate 150.

In the embodiment, the ink of the ink layer 156 can contain a photoinitiator material including one or more photoinitiator compounds that only weakly absorb the radiant energy emitted by the first curing device 120. A sufficiently-high percentage of the radiant energy incident on the ink layer 156 can reach the bottom portion of the ink layer to result in preferential curing of the ink at the interface 158 between the front surface 152 and the ink, due to the radiant energy having a sufficiently-long wavelength.

It is contemplated that, in some embodiments, the photoinitiator material including one or more photoinitiator compounds may be applied directly to the front surface 152 of the substrate 150 before the ink is applied to the front surface 152 at the marking device 110. For example, the photoinitiator material can be applied by jetting, aerosol spraying, during a paper making process of the substrate 150, or using an applicator, such as a coating roll, that contacts the front surface 152. The ink applied over the photoinitiator material may contain a different photoinitiator compound tuned to the radiation emitted by the second curing device 140. Then, the ink is partially cured using the first curing device 120. The composition of the photoinitiator material can be tuned to the spectrum of the radiant energy emitted by the first curing device 120.

In another embodiment, the ink chemistry may cause curing of ink at the top portion of the ink layer to be inhibited by the presence of an effective level of oxygen that has diffused into the ink, promoting preferential curing of the ink at the interface 158.

During partial curing, the substrate 150 can be cooled using a temperature-controlled platen, or the like. For example, the platen can be at a temperature of about 10° C. to about 30° C., such as about 15° C. to about 20° C.

In general, the more the substrate temperature is reduced by chilling on a platen, the more the ink penetration will be reduced. However, chilling requires energy and chilling below the dew point may require more energy to dehumidify the print region to keep water from condensing on the substrate or the platen. Advantageously, embodiments of the apparatus reduce the need for chilling. The optimum combination of chilling and partial curing will depend on various factors, such as ink properties, substrate properties, print head characteristics, and print speed.

Figure 5A:
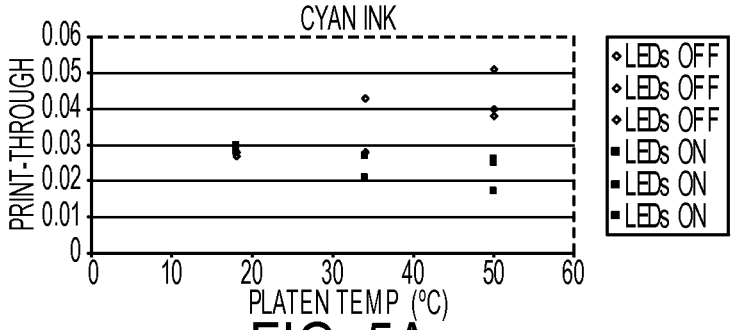
FIGS. 5A, 5B and 5C show plots of the amount of print-through versus platen temperature for a single layer of cyan UV-curable gel ink applied on paper (FIG. 5A); a single layer of magenta UV-curable gel ink applied on paper (FIG. 5B); and a single layer of magenta UV-curable gel ink applied over a single layer of cyan ink on paper (FIG. 5C) with and without partial-curing of the ink.
Figure 5B:
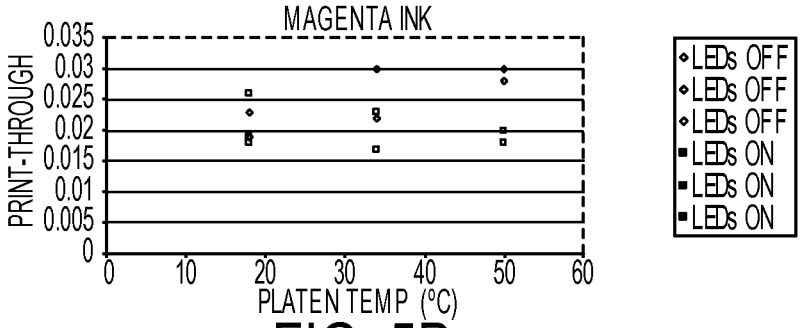
Figure 5C:
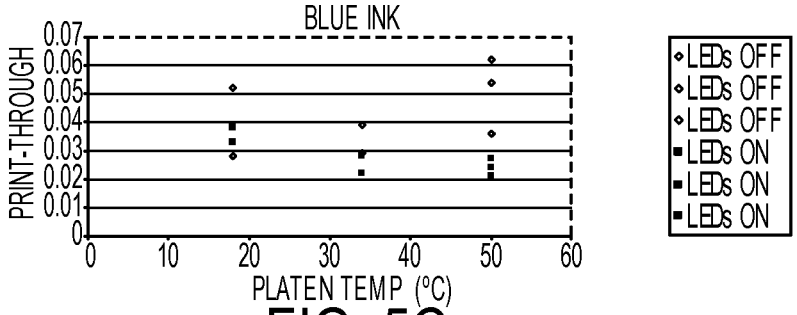

FIGS. 5A, 5B and 5C show effects of partially curing inks immediately after printing onto a web comprising Xerox ColorXpressions+(CX) paper, available from the Xerox Corporation. In FIG. 5A, a single layer of cyan UV-curable gel ink was applied on the paper; in FIG. 5B, a single layer of magenta UV-curable gel ink was applied on the paper; and in FIG. 5C, a single layer of magenta UV-curable gel ink was applied over a cyan ink single layer on the paper. The ink was partially cured using a UV-LED array having an emission spectrum as shown in FIG. 4.

During printing, during the partial curing, and for a short distance after the partial curing, the back surface of the printed web was contacted with a temperature-controlled platen. In FIGS. 5A, 5B and 5C, the amount of ink print-through is plotted versus the platen temperature with partial curing ("LED ON") and without partial curing ("LED OFF"). As shown, without the partial curing, increasing the paper and ink temperature by increasing the platen temperature increased the ink penetration into the paper. In contrast, with partial curing of the ink, increasing the paper and ink temperature by increasing the platen temperature did not increase ink penetration into the paper. For the cyan ink shown in FIG. 5A, increasing the platen temperature appears to increase the level of curing of the ink and reduce ink penetration. This increased curing of the cyan ink may be the result of the partial cure continuing after the ink has been irradiated by the UV-LED array due to the ink having a lower viscosity at the increased temperatures.

In the apparatus 100, the leveling device 130 may include at least one radiant energy source that emits radiant energy onto the partially-cured ink layer 156. The radiation exposure supplies sufficient thermal energy to the ink layer 156 to heat the ink to a point to reduce its viscosity sufficiently to enable the ink to level by surface-tension driven lateral reflow on the front surface 152 of the substrate 150, i.e., non-contact leveling. The radiant energy can have an emission spectrum falling within the visible-infrared portion of the electromagnetic spectrum. In embodiments, the radiant energy source can be, e.g., a broad-band, IR-VIS (infrared-visible radiation) radiant energy source with an emission spectrum that covers the visible range (~400 nm to 700 nm) and extends into the infrared range (>700 nm).

For example, the radiant energy source of the leveling device 130 can be a tungsten halogen lamp, or the like. In such lamps, the wavelength of the emission spectrum peak can be tuned to increase the amount of overlap between the lamp emission spectrum and the absorption spectrum of the ink. The leveling device 130 can include a filter to transmit only a selected portion of the IR-VIS spectrum emitted by the radiant energy source. In other embodiments, the leveling device 130 can include at least one radiant energy source that emits radiation with emission peaks at several different wavelengths, such as a mercury discharge lamp, or the like.

In some embodiments of the apparatus 100, the leveling device 130 can include a device for applying sufficient force to spread the ink on the substrate 150. For example, the leveling device 130 can include an air knife that directs a gas flow onto the ink, where the gas flow applies sufficient force to the ink to spread the ink without contact. In other embodiments, the leveling device 130 can include one or more rolls, e.g., two opposed rolls, which apply sufficient pressure to spread the ink by contacting the image. Depending on the type of device that is used to apply a force to the ink, some partial curing of the top surface of the image may be advantageous, e.g., by preventing a gas flow ejected by an air knife from smearing the image and/or preventing offset to one or more rolls that contact the ink.

The ink applied to a substrate can be leveled by applying pressure to the inks as disclosed in U.S. Patent Application Publication No. 2010/0103235 entitled "Method and Apparatus for Fixing a Radiation-Curable Gel-Ink Image on a Substrate"; U.S. Patent Application Publication No. 2010/0101717 entitled "Dual-Web Apparatus for Fixing a Radiation-Curable Gel-Ink Image on a Substrate" and U.S. Patent Application Publication No. 2010/0101716 entitled "Apparatus for Fixing a Radiation-Curable Gel-Ink Image on a Substrate," each of which is incorporated herein by reference in its entirety.

In these embodiments of the methods, it is desirable to produce leveling of the ink on the substrate surface substantially without any simultaneous curing of the ink. Curing will impede leveling of the corrugated structure formed by ink droplet freezing on substrate impingement. If leveling is impeded, then micro-banding will not be effectively mitigated and completely missing lines will not be effectively covered. In these embodiments, the radiation source used for leveling the ink can be selected to emit radiant energy onto the ink that produces substantially no curing during leveling.

In the apparatus 100, the second curing device 140 emits radiant energy having a spectrum effective to produce further curing of the ink layer subsequent to the leveling. In embodiments, the spectrum of the second curing device 140 is different from the spectrum of the radiant energy emitted by the first curing device 120. For example, the second curing device 140 can comprise a UV-LED array, such as a bar, that emits at a different peak wavelength and intensity than the radiant energy source included in the first curing device 120. Alternatively, the second curing device 140 can include a lamp that emits at a wider range of wavelengths than the first curing device 120.

Figure 6:
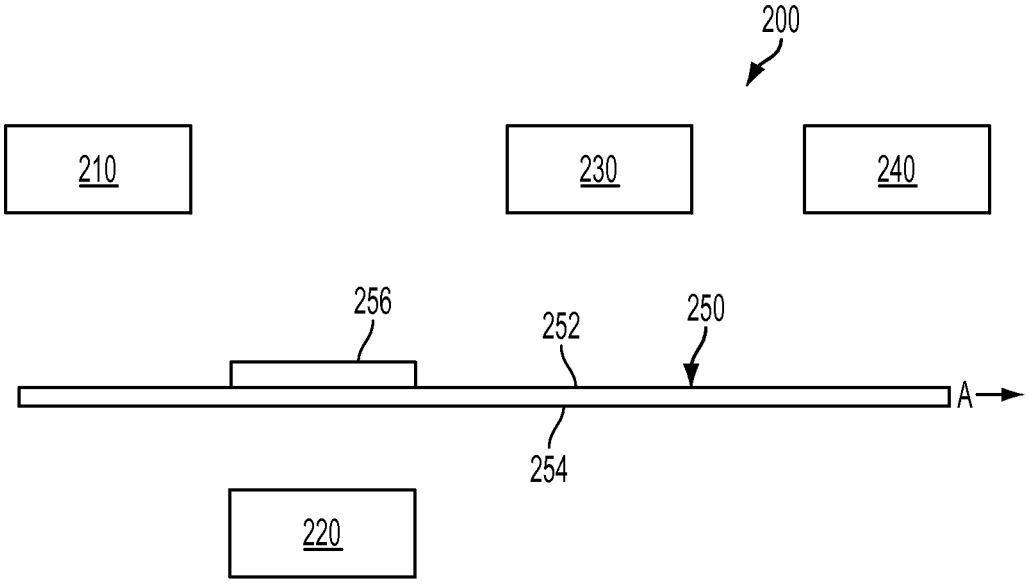
FIG. 6 depicts another exemplary embodiment of a printing apparatus including a partial curing device that irradiates an ink layer on a front surface of a substrate from below the back surface of the substrate.

FIG. 6 depicts an apparatus 200 according to another exemplary embodiment. As shown, the apparatus 200 includes a marking device 210, a first curing device 220, a leveling device 230 and a second curing device 240, arranged in this order along a process direction, A. A substrate 250 having a front surface 252 and an opposite back surface 254 is shown. The marking device 210 deposits ink onto the front surface 252 of the substrate 250 to form an ink layer 256; the first curing device 220 irradiates the ink layer 256 from below the back surface 254 with radiant energy to partially cure the ink layer 256; the leveling device 230 irradiates the partially-cured ink layer 256 with radiant energy to level the ink layer 256 on the front surface 252; and the second curing device 240 irradiates the as-leveled ink layer 256 with radiant energy to further cure the ink layer 256 and provide robustness.

In embodiments, the first curing device 220, leveling device 230 and second curing device 240 are stationary and the substrate 250 is moved past these devices while being irradiated. The transport speed of the substrate 250 past these devices can be varied to control the exposure time of the ink layer 256.

The illustrated substrate 250 is a continuous web of a porous material, such as plain paper. The substrate 250 includes open pores extending partially or completely through the thickness dimension of the substrate 250 between the front surface 252 and the opposite back surface 254.

The apparatus 200 can include a stationary support device (not shown) and the substrate 250 (web) may be pulled over the support device configured to support the web at a fixed distance from the marking device 210, first curing device 220, leveling device 230 and the second curing device 240.

In the apparatus 200, the marking device 210, leveling device 230 and second curing device 240 can have a same construction and function as the marking device 110, leveling device 130 and second curing device 140, respectively, of the apparatus 100.

As shown, first curing device 220 irradiates the back surface 254 of the substrate 250, and the radiant energy passes through the substrate 250 and irradiates the ink layer 256 on the front surface 252. In the embodiment, the ink can contain photoinitiator material effective to strongly absorb the radiant energy. The spectrum of the radiant energy emitted by the first curing device 220 is effective to partially cure the ink layer 256 and reduce penetration of the ink into pores of the substrate 250. The partially-cured ink layer 256 has viscosity and hardness characteristics that allow it to be leveled using the leveling device 230 to spread the ink laterally on the front surface 252 to increase the line width of the ink layer 256. In embodiments, it is desirable to produce a line width of at least about 75 μm on the front surface 252 and control print-through PT to less than about 0.04, such as less than about 0.03, or less than about 0.02.

In the embodiment, photoinitiator material can be applied directly to the front surface 252 of the substrate 250 before the ink is applied to the front surface 252 at the marking device 210. The ink is applied over the photoinitiator material. The ink also contains photoinitiator material. Then, the ink is partially cured using the first curing device 220. The composition of the photoinitiator material can be tuned to the spectrum of the radiant energy emitted by the first curing device 220.

Embodiments of the disclosed methods and apparatuses, which provide partial curing of ink prior to leveling, advantageously can be used to produce good-quality prints using lower quality paper, e.g., paper with non-uniform porosity (e.g., 60 gsm paper, or the like) with less need to cool the paper to control print-through.

It will be appreciated that various ones of the above-disclosed, as well as other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. A method of treating radiation curable gel ink on a porous substrate, comprising:

applying a layer of radiation curable gel ink onto a first surface of a porous substrate;

irradiating the layer of gel ink before the gel ink enters a leveling nip, the irradiating comprising irradiating with first radiation having a first spectrum effective to partially cure the ink layer and reduce penetration of the ink into pores of the substrate;

leveling the partially-cured ink layer at the leveling nip; and irradiating the as-leveled ink layer with second radiation to further cure the ink layer after the as-leveled ink layer exits the leveling nip, the second radiation having a second spectrum different from the first spectrum of the first radiation.

2. The method of claim 1, wherein the first radiation preferentially cures the ink adjacent to the first surface of the substrate to provide a barrier against penetration of the ink into pores of the substrate.

3. The method of claim 1, wherein:

the substrate comprises a second surface opposite to the first surface; and the ink layer is irradiated with the first radiation from above the first surface.

4. The method of claim 1, wherein:

the substrate is a web comprising a second surface opposite to the first surface; and the second surface of the web is irradiated with the first radiation to partially cure the ink layer on the first surface.

5. The method of claim 1, wherein the leveling comprises irradiating the partially-cured ink layer with third radiation effective to heat the ink to a sufficiently-high temperature to allow the ink to flow laterally on the first surface to produce leveling of the ink layer, the third radiation having a different spectrum from the first spectrum and the second spectrum.

6. The method of claim 1, wherein the leveling comprises directing a gas flow onto the partially-cured ink layer, the gas flow applying sufficient force to the ink layer to cause the ink to flow laterally on the first surface to produce leveling of the ink layer.

7. The method of claim 1, wherein the leveling comprises contacting the partially-cured ink layer with at least one roll to apply sufficient force to the ink layer to cause the ink to flow laterally on the first surface to produce leveling of the ink layer.

8. The method of claim 1, wherein the layer of ink is irradiated with the first radiation before any significant penetration of the ink into the pores of the substrate occurs.

9. The method of claim 1, further comprising:

cooling the substrate; and depositing the ink layer on the first surface of the cooled substrate.

10. The method claim 1, wherein:

the ink comprises UV (ultraviolet)-curable ink;

the first radiation comprises first UV radiation having the first spectrum; and the second radiation comprises second UV radiation having the second spectrum.

11. The method of claim 10, wherein the UV-curable ink comprises a gel ink.

12. A method of treating gel ink on a porous substrate, comprising:

applying at least one photoinitiator compound over a first surface of a porous substrate;

applying a layer of gel ink over the first surface having the applied at least one photoinitiator compound;

irradiating the layer of gel ink and the applied at least one photoinitiator compound with first radiation having a first spectrum effective to partially cure the ink layer and reduce penetration of the ink into pores of the substrate, wherein the at least one photoinitiator compound is tuned to the first spectrum;

leveling the partially-cured ink layer, the ink being irradiated and partially cured before the leveling; and irradiating the as-leveled ink layer with second radiation to further cure the ink layer, the second radiation having a second spectrum different from the first spectrum of the first radiation.

13. The method of claim 12, wherein:

the at least one photoinitiator compound is applied directly to the first surface; and the ink layer is applied over the at least one photoinitiator compound.

14. The method of claim 12, wherein the first radiation preferentially cures the ink adjacent to the first surface of the substrate to provide a barrier against penetration of the ink into pores of the substrate.

15. The method of claim 12, wherein:

the substrate comprises a second surface opposite to the first surface; and the ink layer is irradiated with the first radiation from above the first surface.

16. The method of claim 12, wherein:

the substrate is a web comprising a second surface opposite to the first surface; and the second surface of the web is irradiated with the first radiation to partially cure the ink layer on the first surface.

17. The method of claim 12, wherein the leveling comprises irradiating the partially-cured ink layer with third radiation effective to heat the ink to a sufficiently-high temperature to allow the ink to flow laterally on the first surface to produce leveling of the ink layer, the third radiation having a different spectrum from the first spectrum and the second spectrum.

18. The method of claim 12, wherein the leveling comprises applying sufficient force to the ink layer to cause the ink to flow laterally on the first surface to produce leveling of the ink layer.

19. The method of claim 12, further comprising:

cooling the substrate; and depositing the ink layer on the first surface of the cooled substrate.

20. The method of claim 12, wherein:

the ink comprises a UV (ultraviolet)-curable ink;

the first radiation comprises UV radiation.

21. The method of claim 12, the leveling further comprising contact leveling by contacting the ink layer with a leveling member, the ink being irradiated and partially cured before the contacting, the irradiating the as-leveled ink layer being after the contacting the ink layer with the leveling member.

22. An apparatus useful in treating ink on a porous substrate, comprising:

a marking device for applying a layer of ink onto a first surface of a porous substrate;

a first curing device for irradiating the layer of ink with first radiation having a first spectrum effective to partially cure the ink layer and reduce penetration of the ink into pores of the substrate;

a leveling device for leveling the partially-cured ink layer after the irradiating the ink at the first curing device, and before further curing the partially-cured ink layer; and a second curing device for irradiating the as-leveled ink layer with second radiation to further cure the ink layer, the second radiation having a second spectrum different from the first spectrum of the first radiation.

23. The apparatus of claim 22, wherein:

the substrate comprises a second surface opposite to the first surface; and the first curing device is positioned to irradiate the ink layer with the first radiation from above the first surface.

24. The apparatus of claim 22, wherein:

the substrate comprises a second surface opposite to the first surface; and the first curing device is positioned to irradiate the second surface of the substrate with the first radiation to partially cure the ink layer on the first surface.

25. The apparatus of claim 22, wherein:

the ink comprises UV (ultraviolet)-curable ink;

the first curing device emits first UV radiation having the first spectrum onto the ink layer; and the second curing device emits second UV radiation having the second spectrum onto the as-leveled ink layer.

26. The apparatus of claim 22, wherein the leveling device irradiates the partially-cured ink layer with third radiation effective to heat the ink to a sufficiently-high temperature to allow the ink to flow laterally on the first surface to produce leveling of the ink layer, the third radiation having a different spectrum from the first spectrum and the second spectrum.

27. The apparatus of claim 22, wherein the leveling device directs a gas flow onto the partially-cured ink layer, the gas flow applying sufficient force to the ink layer to cause the ink to flow laterally on the first surface to produce leveling of the ink layer.

28. The apparatus of claim 22, wherein the leveling device comprises at least one roll that contacts the partially-cured ink layer and applies sufficient force to the ink layer to cause the ink to flow laterally on the first surface to produce leveling of the ink layer.

* * * * *